US007775674B1

(12) United States Patent
Ward

(10) Patent No.: US 7,775,674 B1
(45) Date of Patent: Aug. 17, 2010

(54) METHOD AND APPARATUS FOR ILLUMINATING ICE

(75) Inventor: Matthew E. Ward, Philadelphia, PA (US)

(73) Assignee: Barco, Inc., Duluth, GA (US)

( * ) Notice: Subject to any disclaimer, the term of this patent is extended or adjusted under 35 U.S.C. 154(b) by 133 days.

(21) Appl. No.: 12/208,086

(22) Filed: Sep. 10, 2008

Related U.S. Application Data

(60) Provisional application No. 60/971,078, filed on Sep. 10, 2007.

(51) Int. Cl.
*F21S 8/00* (2006.01)
*F21V 33/00* (2006.01)
*A63C 19/10* (2006.01)

(52) U.S. Cl. ..... 362/153; 362/153.1; 362/92; 62/235; 62/264

(58) Field of Classification Search ..... 362/153, 362/153.1, 800, 92; 62/235, 264
See application file for complete search history.

(56) References Cited

U.S. PATENT DOCUMENTS

| | | | | |
|---|---|---|---|---|
| 4,667,481 | A * | 5/1987 | Watanabe et al. | 62/235 |
| 6,314,669 | B1 | 11/2001 | Tucker | |
| 6,704,989 | B1 | 3/2004 | Lutz et al. | |
| 6,813,853 | B1 | 11/2004 | Tucker | |
| 6,866,589 | B1 * | 3/2005 | Widrick et al. | 472/90 |
| 7,063,449 | B2 | 6/2006 | Ward | |
| 7,089,753 | B2 | 8/2006 | Hoeks | |
| 2005/0116667 | A1 | 6/2005 | Mueller et al. | |

* cited by examiner

*Primary Examiner*—Jong-Suk (James) Lee
*Assistant Examiner*—Jacob Y Choi
(74) *Attorney, Agent, or Firm*—Aka Chan LLP

(57) ABSTRACT

A light emitting system to illuminate ice and a method for illuminating ice are disclosed herein. The system includes multiple light emitting modules that each includes a light source having at least one light emitting element and a cover having a base. The base substantially surrounds the light source. The light emitting modules may then be electrically connected to each other.

19 Claims, 5 Drawing Sheets

METHOD AND APPARATUS FOR ILLUMINATING ICE

CROSS-REFERENCE TO RELATED APPLICATIONS

This application, pursuant to 35 U.S.C. §119(e), claims priority to U.S. Patent Application Ser. No. 60/971,078 filed on Sep. 10, 2007 and entitled "Method and Apparatus for Illuminating Ice" in the name of Matthew Ward, which is hereby incorporated by reference in its entirety.

BACKGROUND

1. Field of the Disclosure

Embodiments disclosed herein generally relate to a light emitting system used to display images and/or videos. More specifically, embodiments disclosed herein relate to a light emitting system that may be used within an ice rink.

2. Background Art

Display units for entertainment, architectural, and advertising purposes have commonly been constructed of numbers of light emitting elements, such as LEDs or incandescent lamps mounted onto flat panels. These light emitting elements may be selectively turned on and off to create patterns, graphics and video displays for both informational and aesthetic purposes. It is well known to construct these displays of tiles or large panels, each containing several light emitting elements, which may be assembled in position for an entertainment show or event, or as an architectural or advertising display. Examples of such systems are disclosed in U.S. Pat. Nos. 6,813,853, 6,704,989 and 6,314,669.

These strip and/or tile based display systems may commonly be constructed using rear-mounted LED light sources in an enclosure that projects light onto a screen or diffuser. An example of such a system is the 'Versa TILE' product manufactured by Element Labs Inc. of Austin, Tex., USA. Further examples of such systems are disclosed by Ward in U.S. Pat. No. 7,063,449, assigned to the Applicants of the present application.

For illuminating ice then, it is generally known to embed light sources into the ice of an ice rink U.S. Pat. No. 4,667,481, issued to Watanabe et al, describes a means for embedding either incandescent lights or LEDs under an ice rink and also ensure that the heat from the light sources do not melt the ice. Watanabe describes the ice making process as normally taking about one week. Such under-ice lighting systems may be used for dynamic lighting to enhance a theatrical or dance production. The systems may also be used to provide markings or delineations needed for events, such as ice hockey matches or other sporting activities. An array of light sources may also be used to provide a video display under the ice for entertainment or scoring purposes.

Further, there is an increasing need for embedded lighting and/or video systems within temporary ice rinks. Touring theatrical events, ice shows, and spectaculars may use a temporary ice rink that is capable of quick deployment and removal. U.S. Pat. No. 7,089,753 issued to Finhoeks, describes a temporary ice rink capable of rapid deployment and removal. Further examples of temporary ice rinks may also be seen in the products from Custom Ice Rink Inc. of Burlington, Ontario, Canada and Ice World of Baarn, Netherlands. However, because ice from the ice rink usually completely surrounds the lighting devices, a system may require the complete melting of the ice before being removed. Otherwise, damage to the light sources of the light emitting system could occur. As such, it may be advantageous to provide a system that could be more easily removed and not be retained by partially melted ice.

SUMMARY OF THE DISCLOSURE

In one aspect, embodiments disclosed herein relate to a light emitting system to illuminate ice. The system includes a first light emitting module and a second light emitting module, in which each of the first and second light emitting modules includes a light source having at least one light emitting element and a cover having a base. The base substantially surrounds the light source and the first light emitting module is electrically connected to the second light emitting module.

Further, in another aspect, embodiments disclosed herein relate to a method for illuminating ice. The method includes disposing a plurality of light emitting modules on top of a first substrate, in which each of the plurality of light emitting modules includes a light source having at least one light emitting element and a cover having a base. The base substantially surrounds the light source to provide protection for the light source. The method further includes disposing a freezing system above the first substrate, disposing an aggregate on top of the first substrate such that a top surface of the covers of the plurality of light emitting modules is visible, and forming ice above the aggregate with the freezing system such that the top surface of the covers of the plurality of light emitting modules is configured to emit light within the ice.

Furthermore, in yet another aspect, embodiments disclosed herein relate to a method of manufacturing a light emitting system to illuminate ice. The method includes providing a first base and a second base, in which each of the first and second bases comprises a light source with a light emitting element attached thereto. The method then further includes disposing a first cover over the first base to substantially surround the first light source, thereby creating a first light emitting module, disposing a second cover over the second base to substantially surround the second light source, thereby creating a second light emitting module, and electrically connecting the first light emitting module to the second light emitting module.

Finally, in yet another aspect, embodiments disclosed herein relate to a method for illuminating ice. The method includes providing a first light emitting module and a second light emitting module, in which each of the first and second light emitting modules includes a light source having at least one light emitting element and a cover having a base. The base substantially surrounds the light source. The method then further includes disposing the first and second light emitting modules on top of a first substrate and forming ice above the first and second light emitting modules such that a top surface of the first and second light emitting modules is substantially covered with ice.

Other aspects and advantages of the present disclosure will be apparent from the following description and the appended claims.

DETAILED DESCRIPTION

Figure 1:
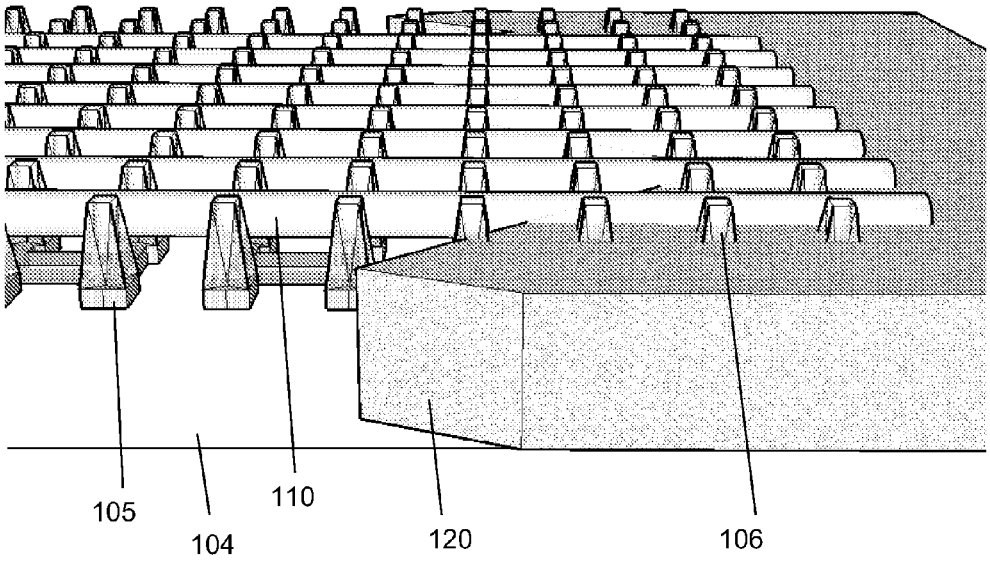
FIG. 1 shows a perspective side view of a light emitting system in accordance with embodiments disclosed herein.

Specific embodiments of the present disclosure will now be described in detail with reference to the accompanying figures. Like elements in the various figures may be denoted by like reference numerals for consistency. Further, in the following detailed description of embodiments of the present disclosure, numerous specific details are set forth in order to provide a more thorough understanding of the invention. However, it will be apparent to one of ordinary skill in the art that the embodiments disclosed herein may be practiced without these specific details. In other instances, well-known features have not been described in detail to avoid unnecessarily complicating the description.

The present disclosure may provide for a light emitting system, such as a light emitting diode ("LED") lighting or video system, to be incorporated into an ice rink, such as a touring skating rink. The system may be quickly and easily deployed and removed, in addition to also being easily removed during the melting of the ice within the ice rink. Additionally, the system may be protected from any excessive force and pressure (e.g., shocks) that are transmitted through the ice. Further, the system may be installed on uneven surfaces when desired.

Referring now to FIG. 1, a perspective side view of a light emitting system in accordance with embodiments disclosed herein is shown. The light emitting system includes one or more light emitting modules 105, in which the light emitting modules 105 may be disposed and/or mount to the ice rink substrate 104. The light emitting modules 105 may then have a cover 106, in which the cover 106 may provide protection for the light emitting devices disposed within the light emitting modules 105. Further, the cover 106 may be used as a light guide to direct light from within the light emitting module 105 through and into the covering ice layer. As such, the cover 106 may be formed of silicone or any other similar material known in the art. When the light emitting modules 105 have been disposed upon the ice rink substrate 104, loose fill aggregate 120 (e.g., sand), may then cover, such as a substantial portion, of the light emitting modules 105.

Further, a freezing system 110, such as shown with pipes, may be used with the light emitting system, or may be incorporated into the light emitting system 110. As shown in FIG. 1, the freezing system 110 is disposed above the light emitting modules 105, such as by resting on the top layer of the loose fill aggregate. Those having ordinary skill in the art will appreciate, however, that other methods of cooling and freezing ice may be used without departing from the scope of the present disclosure. For example, the cooling system may be disposed below the light emitting modules of the light emitting system, or the light emitting modules and the freezing system may be manufactured as single units.

Figure 2:
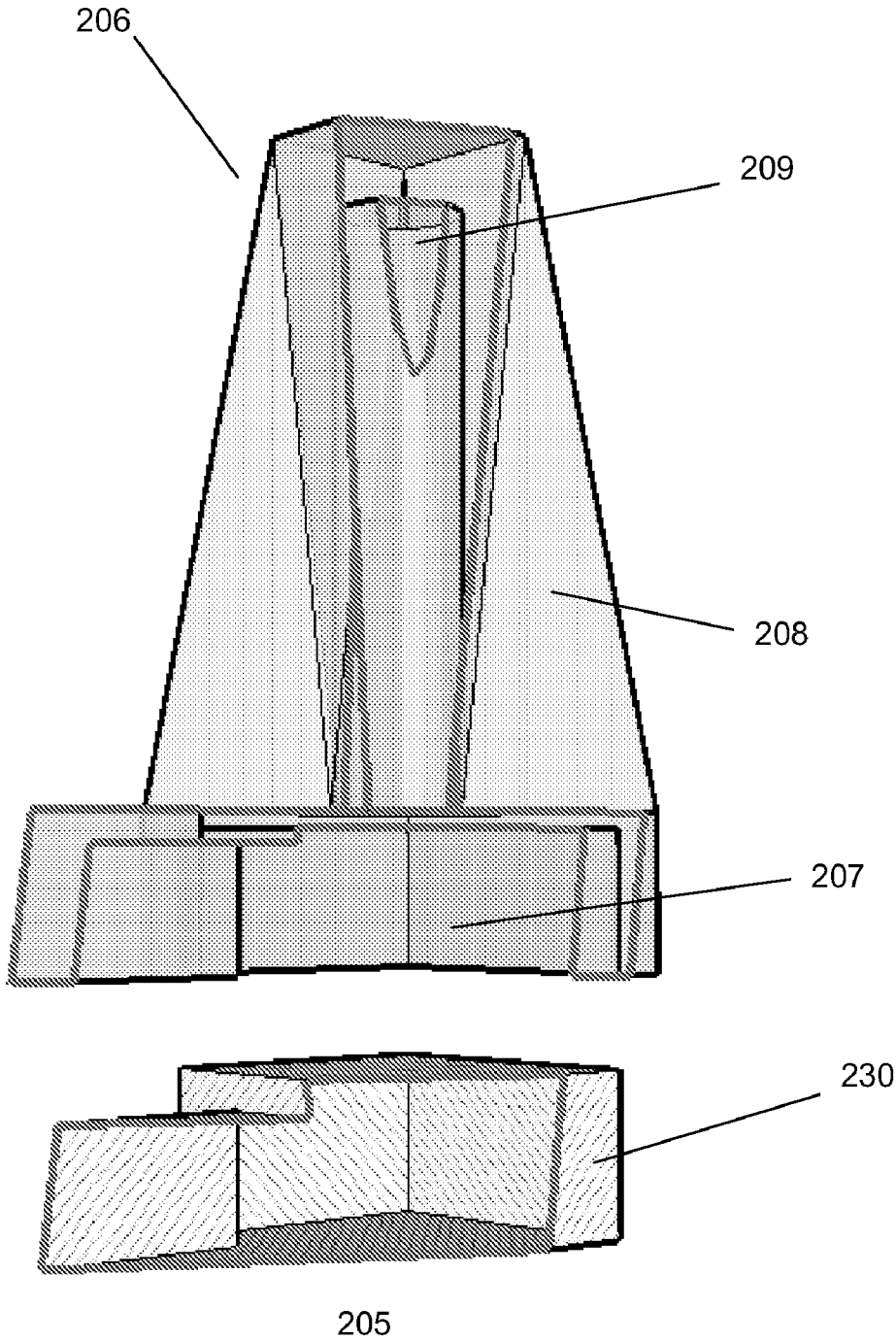
FIG. 2 shows an enlarged exploded view of a light emitting module 205 in accordance with embodiments disclosed herein.

Referring now to FIG. 2, an enlarged exploded view of a light emitting module 205 in accordance with embodiments disclosed herein is shown. The light emitting module 205 may include one or more light emitting elements. As such, the light emitting module 205 includes a light source 230 disposed therein. The light emitting element may then include a light emitting diode, an organic light emitting diode, a polymer light emitting diode, or any other light emitting element know in the art. Generally though, the light emitting pixel will include multiple light emitting elements. Assuming then that more than one light emitting element is used within a light emitting pixel, the light emitting elements may then be the same or different colors, or the same or different sizes, or the same or different types.

As discussed above, the light emitting module 205 may include a cover 206, in which the cover 206 may be disposed about and/or around the light source 230. The cover 206 may then be used to protect the light source 230 from excessive temperatures, excessive forces, and/or excessive electrical signals. Further, as discussed above, the cover 206 may be formed from a variety of materials. For example, the cover may be formed from a substantially transparent material, such as a clear material. This clear material may include a hard silicone or optically similar material.

However, in addition to this transparent material, the cover 206 may include materials having various other properties to have many desired effects. In other embodiments, the cover may include a diffusive material, so as to diffuse the light when being transmitted through the carrier, a colored material, so as to effect the light color when being transmitted through the carrier, a refractive material, so as to effect the angle of the light when being transmitted through the carrier, and a reflective material, so as to reflect some or all of the light with the carrier. Further, the cover may include a lens disposed or formed therein, such as molded lens elements for shaping and manipulating the light emitting from the light source, and the surface of the cover may be smooth, roughened, lenticular, or faceted. These materials and features for the cover may then be used in combination when constructing the housing.

As shown, the cover 206 may include a base 207, in which the base 207 may then surround and wrap around the light source 230 so as to cover and protect the light source 230. Further, the cover 206 may include a light guide 209, such as disposed therein or formed therein, in which the light guide 209 is optically coupled with the light source 230. For example, the refractive index of the light guide 209 may be selected to be used to guide light therethrough. As such, the light guide 209 may be used to emit light from the light source 230 effectively and efficiently through the cover 206 such that light appears to emerge from the top of the cover 206 and into the ice.

Still referring to FIG. 2, the light emitting module 205 may include structures and devices to increase the stability of the light emitting module 205. As such, as shown in FIG. 2, the cover 206 may include fin structures disposed thereon or formed thereon, such as disposed on the outer surface about the base 207 of the cover 206. These fin structures 208 may then increase the stability and/or constrain the movement of the cover 206 within the aggregate and the ice. Further, all features and the overall shape of the cover 206 may be designed to be tapered and/or convex such that the light emitting system and the light emitting modules may be easily removed, such as from the surrounding ice and aggregate. For example, concave or re-entrant surfaces for the cover may impede the removal of the light emitting modules and system from the surrounding ice and aggregate until completely thawed. As such, the shape of the covers may facilitate the removal of the light emitting system before having the ice and aggregate completely thawed.

Figure 3:
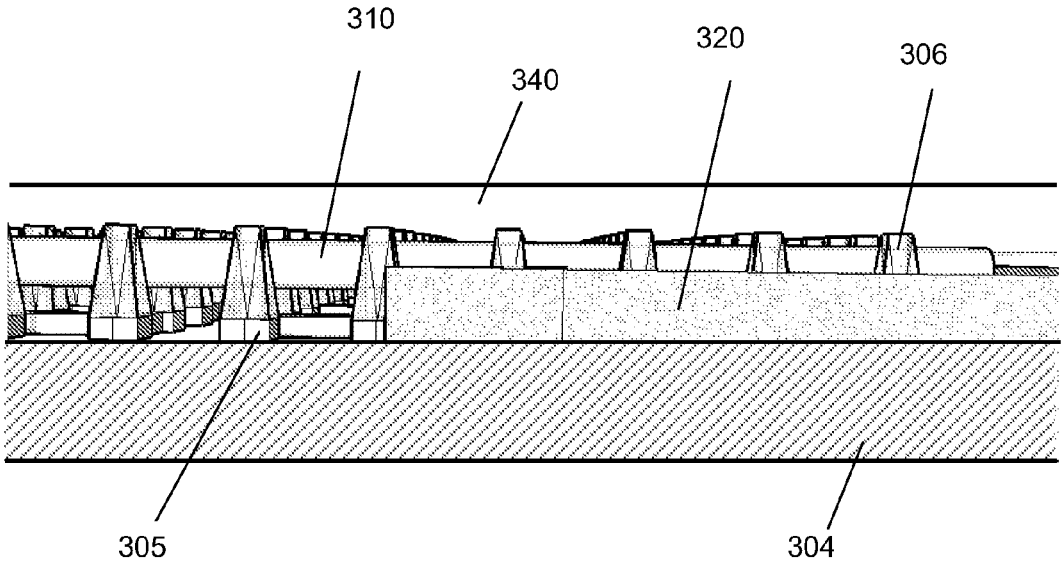
FIG. 3 shows a perspective side view of a light emitting system in accordance with embodiments disclosed herein.

Referring now to FIG. 3, a perspective side view of a light emitting system in accordance with embodiments disclosed herein is shown. In this embodiment of the light emitting system, the light emitting modules 305 may be disposed and/or mounted upon the substrate 304. As discussed above, the substrate 304 may be that of an ice rink. Then, the loose fill aggregate 320 may be disposed over the light emitting modules 305 so as to substantially cover the light emitting modules 305. When using the loose fill aggregate 320, preferably the cover 306 of the light emitting modules 305 protrudes above the top surface of the aggregate 320. As such, light may then be emitted through the top surface of the cover 306 of the light emitting modules 305. The aggregate 320 may be an insulating material to protect the substrate 304, in addition to portions of the light emitting modules 305, from low temperatures. For example, the aggregate 320 may be a material such as sand (described above), gravel, or any other material having low thermal conductivity known in the art. Further, the aggregate 320 may also be used to provide a level, smooth, non-damaging surface. As such, the freezing system 310 may then rest upon and/or be, at least partially, submerged within the aggregate 320. Ice 340 is then generally formed on top of the aggregate 320 and may fully enclose and encompass the protruding tops of the covers 306 of the light emitting modules 305. As such, light emerging from the tops of the covers 306 may then be transmitted into and through the ice 340.

Figure 4:
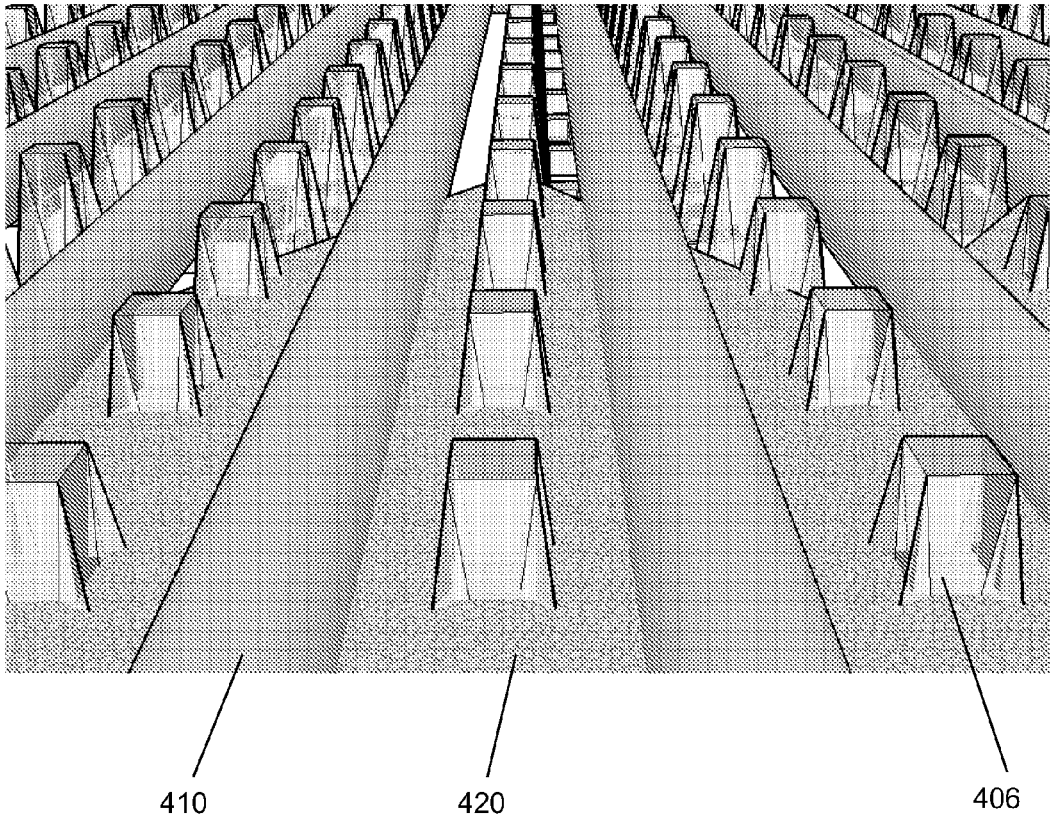
FIG. 4 shows a top perspective view of the light emitting system in accordance with embodiments disclosed herein.

After use of the light emitting system, the freezing system 310 may be turned off such that the ice 340 would be allowed to thaw. This thawing process of the ice 340 may be facilitated by illuminating one or more of the light emitting modules 305, in which the heat from the light emitting modules 305 may be transmitted to the ice 340. As the ice 340 then begins to melt and/or break apart, the light emitting modules 305 may then be removed. As discussed above, a conical, tapered, and/or concave shape for the covers 306 of the light emitting modules 305 may prevent ice 340 from trapping and restricting the removal of the light emitting modules 305. FIG. 4 then shows an alternative top perspective view of the light emitting system in accordance with embodiments disclosed herein. In this figure, the tops of the covers 406 are shown, along with the freezing system 410 and the aggregate 420.

Figure 5:
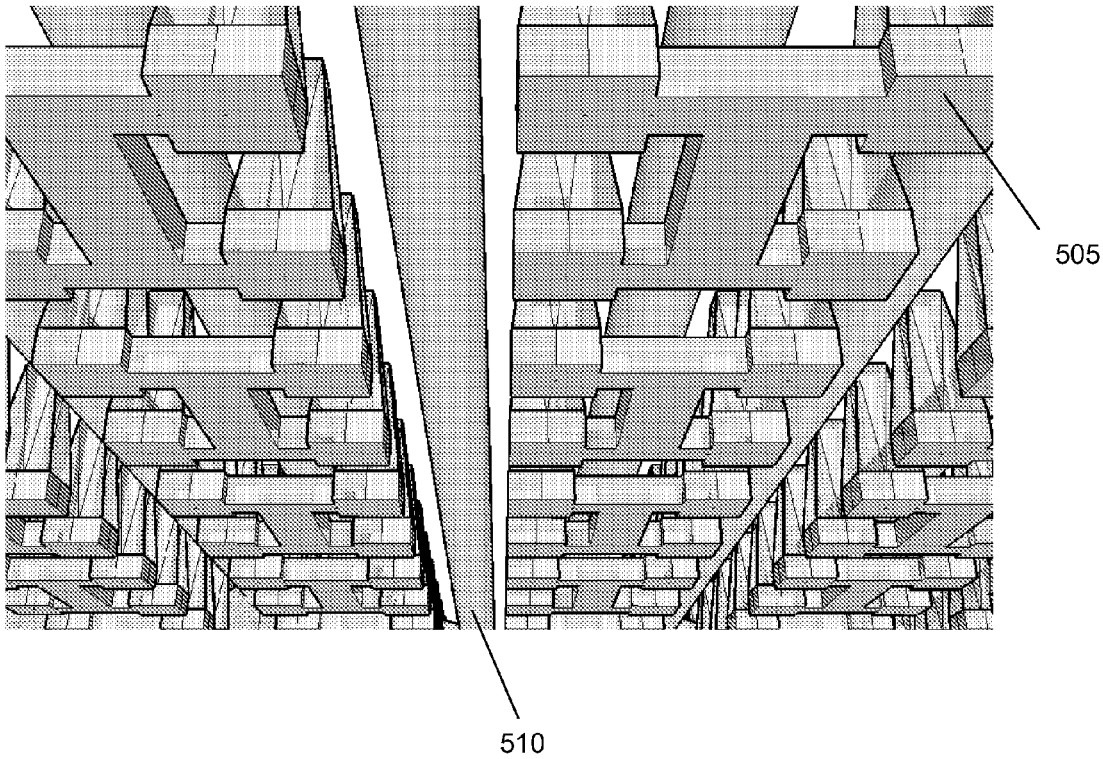
FIG. 5 shows a perspective view of the bottom of the light emitting system in accordance with embodiments disclosed herein.

Referring now to FIG. 5, a perspective view of the bottom of the light emitting system in accordance with embodiments disclosed herein is shown. The light emitting modules 505 of the light emitting system may have substantially flat bottom surfaces such that the light emitting modules 505 may sit securely upon a substrate. Further, the light emitting modules 505 may be interconnected and grouped together to facilitate the connection and handling of the modules 505. For example, as shown in this embodiment, the light emitting modules 505 are configured within groups of four. A grouping of four may provide for a more stable configuration of the light emitting modules 505. Those having ordinary skill in the art, though, will appreciate that the light emitting modules may be grouped in any size and arrangement, or may alternatively not be grouped to each other at all, so as to not depart from the scope of the present disclosure.

Further, the light emitting modules of the light emitting system may be electrically connected to each other, in addition to being electrically connected to a power unit and/or a processor. The power unit and the processor may send power signals and/or data signals back and forth with the light emitting modules, in particular with the light emitting elements. Based on the power signal, the light emitting elements may be selectively powered on and off or emit light with varying intensities, and based on the data signal, the light emitting elements may selectively emit light of different colors. Furthermore, with multiple light emitting elements, the light emitting modules, in accordance with embodiments disclosed herein, may be configured to display an image based upon the power and data signals.

Embodiments of the present disclosure may provide for one or more of the following advantages. First, the present disclosure may provide for a light emitting system that may be used within an ice rink. The ice rink may be a permanent or temporary, in which the light emitting system may be used to illuminate and provide lighting within the ice of the ice rink. Next, the present disclosure may provide for a light emitting system that may be easily and conveniently installed and/or removed within an ice rink. For example, by incorporating multiple light emitting modules within the system, the light emitting modules may be designed to be easily removed from ice during thawing. Further, the present disclosure may provide for a light emitting system that is configurable within an ice rink. For example, the light emitting modules of the light emitting system may be individually moved and configured for the desired effect of the operator.

While the invention has been described with respect to a limited number of embodiments, those skilled in the art, having benefit of this disclosure, will appreciate that other embodiments may be devised which do not depart from the scope of the invention as disclosed herein. Accordingly, the scope of the invention should be limited only by the attached claims.

What is claimed is:

1. A light emitting system to illuminate ice, the system comprising:

a first light emitting module and a second light emitting module, wherein each of the first and second light emitting modules comprises:

a light source having at least one light emitting element; and a cover having a base;

wherein the base substantially surrounds the light source;

wherein the first light emitting module is electrically connected to the second light emitting module;

the first and second light emitting modules comprise a light pipe disposed within the cover and optically coupled to the light source such that light emitting from the light source is emitted from a top surface of the cover;

and the system is adapted to have ice form above the first and second light emitting modules such that a top surface of the first and second light modules is covered by ice.

2. The light emitting apparatus of claim 1, wherein the cover comprises a tapered shape and fin structures attached to the outside thereof.

3. The light emitting apparatus of claim 1, wherein the cover comprises silicone.

4. The light emitting apparatus of claim 1, wherein the cover comprises at least one of a diffusive material, a transparent material, and a translucent material.

5. The light emitting apparatus of claim 1, wherein the cover comprises at least one of a colored material and a patterned material.

6. The light emitting apparatus of claim 1, wherein the at least one light emitting element comprises at least one of a light emitting diode and an incandescent lamp.

7. The light emitting apparatus of claim 1, wherein the at least one light emitting element comprises a plurality of light emitting elements.

8. A method for illuminating ice, the method comprising:

disposing a plurality of light emitting modules on top of a first substrate, wherein each of the plurality of light emitting modules comprises:

a light source having at least one light emitting element;

a cover having a base; and a light guide disposed within the cover and optically coupled to the light source such that light emitting from the light source is emitted from a top surface of the cover;

wherein the base substantially surrounds the light source to provide protection for the light source;

disposing a freezing system above the first substrate;

disposing an aggregate on top of the first substrate such that the top of the covers of the plurality of light emitting modules is visible, and configuring the top surface of the covers of the plurality of light emitting modules such that the top surface will emit light through an ice that is formed above the aggregate with the freezing system.

9. The method of claim 8, wherein the top surface of the covers of the plurality of light emitting modules is enclosed within the ice.

10. The method of claim 8, wherein the aggregate is disposed on top of the first substrate such that at least a portion of at least one of the light emitting modules is encompassed by the aggregate.

11. The method of claim 8, wherein the plurality of light emitting modules are electrically connected therebetween.

12. The method of claim 8, wherein the light source of at least one of the plurality of light emitting modules is thermally protected from the ice.

13. A method of manufacturing a light emitting system to illuminate ice, the method comprising:

providing a first base and a second base, wherein each of the first and second bases comprises a light source with a light emitting element attached thereto;

disposing a first cover over the first base to substantially surround the first light source, thereby creating a first light emitting module;

disposing a second cover over the second base to substantially surround the second light source, thereby creating a second light emitting module;

disposing a first light guide in the first cover such that light from the first light source emits from a top surface of the first cover;

disposing a second light guide in the second cover such that light from the second light source emits from a top surface of the second cover;

adapting the top surface of the first cover such that the top surface will emit light through an ice that is formed over the top surface of the second cover;

adapting the top surface of the second cover such that the top surface will emit light through an ice that is formed over the top surface of the second cover; and electrically connecting the first light emitting module to the second light emitting module.

14. The method of claim 13, further comprising:

disposing a first light pipe within the first cover and optically coupling the first light pipe to the first light source such that light emitting from the first light source is emitted to a top surface of the first cover.

15. The light emitting apparatus of claim 13, wherein the first cover comprises a tapered shape and fin structures attached to an outside thereof.

16. A method for illuminating ice, the method comprising:

providing a first light emitting module and a second light emitting module, wherein each of the first and second light emitting modules comprises:

a light source having at least one light emitting element; and a cover having a base;

wherein the base substantially surrounds the light source;

wherein the first and second light emitting modules comprise a light pipe disposed within the cover and optically coupled to the light source such that light emitting from the light source is emitted from a top surface of the cover;

disposing the first and second lighting modules on top of a first substrate, and configuring the top surface of the first and second light emitting modules such that the top surface will emit light through an ice that is formed above first and second light emitting modules.

17. The method of claim 16, further comprising electrically connecting the first and second light emitting modules.

18. The method of claim 16, wherein the first and second light emitting modules are configured to emit light within the ice.

19. The method of claim 16, wherein the cover comprises a tapered shape and fin structures attached to the outside thereof.

* * * * *